US011339554B2

(12) United States Patent
Letscher et al.

(10) Patent No.: US 11,339,554 B2
(45) Date of Patent: May 24, 2022

(54) METHOD FOR CONTROLLING THE ENGINE SPEED OF A UTILITY VEHICLE

(71) Applicant: DEERE & COMPANY, Moline, IL (US)

(72) Inventors: Jens Letscher, Mannheim (DE); Florian Reinmuth, Mannheim (DE); Florian Schott, Mannheim (DE)

(73) Assignee: DEERE & COMPANY, Moline, IL (US)

( * ) Notice: Subject to any disclaimer, the term of this patent is extended or adjusted under 35 U.S.C. 154(b) by 899 days.

(21) Appl. No.: 15/946,298

(22) Filed: Apr. 5, 2018

(65) Prior Publication Data

US 2018/0305900 A1 Oct. 25, 2018

(30) Foreign Application Priority Data

Apr. 21, 2017 (DE) ..... 102017206713.6

(51) Int. Cl.

| | |
|---|---|
| ***E02F 9/22*** | (2006.01) |
| ***F02D 31/00*** | (2006.01) |
| ***E02F 3/43*** | (2006.01) |
| ***E02F 3/42*** | (2006.01) |
| ***E02F 9/20*** | (2006.01) |
| ***F02D 35/00*** | (2006.01) |
| ***F15B 19/00*** | (2006.01) |
| ***F15B 21/08*** | (2006.01) |

(Continued)

(52) U.S. Cl.

CPC ..... *E02F 9/2246* (2013.01); *E02F 3/422* (2013.01); *E02F 3/431* (2013.01); *E02F 9/2066* (2013.01); *E02F 9/2228* (2013.01); *F02D 31/001* (2013.01); *F02D 31/006* (2013.01); *F02D 35/00* (2013.01); *F15B 19/00* (2013.01); *F15B 21/08* (2013.01); *F02D 29/02* (2013.01); *F02D 41/021* (2013.01); *F02D 2200/50* (2013.01); *F02D 2200/60* (2013.01)

(58) Field of Classification Search

CPC ..... E02F 9/2246; E02F 3/422; E02F 3/431; E02F 9/2066; E02F 9/2228; F02D 31/001; F02D 31/006; F02D 35/00; F02D 29/02; F02D 41/021; F02D 2200/50; F02D 2200/60; F15B 19/00; F15B 21/08

USPC ..... 701/50

See application file for complete search history.

(56) References Cited

U.S. PATENT DOCUMENTS

2014/0371915 A1* 12/2014 Ishihara ..... B60W 20/00 700/275
2015/0225927 A1* 8/2015 Hoshino ..... B60W 10/30 701/50
2015/0275799 A1* 10/2015 Koide ..... B60W 30/18063 701/50

FOREIGN PATENT DOCUMENTS

DE 3626584 A1 6/1987
DE 112006002346 T5 8/2008

(Continued)

OTHER PUBLICATIONS

European Search Report issued in counterpart application No. 18167961.4 dated Aug. 29, 2018. (8 pages).

(Continued)

*Primary Examiner* — Paula L Schneider

(57) ABSTRACT

A method is provided for controlling engine speed of a drive engine of a utility vehicle having a drivable loading apparatus. The method includes detecting or predicting a driving movement of the loading apparatus, and requesting an increase of engine speed if the movement of the loading apparatus is predicted or detected.

20 Claims, 4 Drawing Sheets

(51) Int. Cl.
*F02D 41/02* (2006.01)
*F02D 29/02* (2006.01)

(56) References Cited

FOREIGN PATENT DOCUMENTS

| | | | | | |
|---|---|---|---|---|---|
| DE | 112012000075 | T5 | | 8/2013 | |
| DE | 112006002935 | B4 | | 9/2013 | |
| DE | 112012005571 | T5 | | 9/2014 | |
| JP | 2009281149 | | * | 12/2009 | ..... E02F 9/22 |

OTHER PUBLICATIONS

German Search Report issued in counterpart application No. 102017206713.6 dated Jan. 22, 2018. (10 pages).

* cited by examiner

METHOD FOR CONTROLLING THE ENGINE SPEED OF A UTILITY VEHICLE

RELATED APPLICATIONS

This application claims priority to German Patent Application Ser. No. 102017206713.6, filed Apr. 21, 2017, the disclosure of which is hereby incorporated by reference in its entirety.

FIELD OF THE DISCLOSURE

The present disclosure relates to a method for controlling the engine speed of a utility vehicle.

BACKGROUND

Agricultural utility vehicles such as tractors sometimes have a front loader for handling specific work such as earth moving or transporting crop material. If working movements of the front loader are dependent on the engine power of a drive engine for the utility vehicle, this can have an influence on the ground speed of the utility vehicle.

There is a need, however, for an improved control of engine speed of a drive engine of a utility vehicle.

SUMMARY

In a first embodiment of the present disclosure, a method for controlling an engine speed of a drive engine of a utility vehicle includes a plurality of steps. In one method step, movement driving of the loading apparatus is predicted or detected. In particular, a request or a performance of movement driving, or a working movement of the loading apparatus, is predicted or detected. If movement driving or a working movement of the loading apparatus has been predicted or detected, an increase of the rotational speed of the drive engine is requested. In this way, the engine power of the drive engine can automatically be increased and therefore adapted to specific working movements of the loading apparatus. Consequently, a vehicle speed of the utility vehicle, which is usually defined by an accelerator pedal and a brake pedal, is clearly influenced less by the operation of the loading apparatus, or not influenced at all. As a result, there may be an increase in comfort for the operator. In other words, the vehicle speed can be maintained by means of this comfort function independently of the specific drive movements of the loading apparatus. A vehicle transmission, more particularly a transmission ratio, is automatically controlled depending on an increase of engine rotational speed, such that a vehicle speed set by the operator remains constant. Undesired accelerations or decelerations of the utility vehicle can be avoided in this way.

Proceeding from the control of the engine speed as explained, the method supports an improved control or handling of the utility vehicle and the loading apparatus.

An operating state of the loading apparatus is used to predict or detect movement driving of the loading apparatus. The operating state can be deactivated or activated, i.e., the loading apparatus is in general switched off (deactivated) or switched on (activated) as a prerequisite for a subsequent movement driving or for a subsequent request or performance of a specific drive movement of the loading apparatus. In an activated operating state, it can be inferred that movement driving of the loading apparatus will actually take place. In this manner, a future movement driving of the loading device can be predicted.

The utility vehicle is designed as an agricultural vehicle, more particularly a tractor, a towing vehicle or the like. The loading apparatus is a working apparatus in the front or rear area of the utility vehicle. In particular, the loading apparatus has a front loader or consists of a front loader. For instance, it has a movable or pivotable arm on which a working unit or a tool (e.g., shovel, fork, and gripper) is mounted.

In one embodiment, the engine speed is an idle speed of the drive engine when the vehicle is stationary. In this state, auxiliary and working functions (e.g., PTO operation, hydraulic auxiliary functions) of the utility vehicle are not active, or have been switched off. In this manner, the utility vehicle can be adapted to impending movement driving of the loading apparatus already while stationary.

The elevated engine speed is reduced when a predetermined waiting period (e.g., starting from the time when the engine speed was increased) has expired, and if no movement driving has been carried out or at least requested within this waiting period. This limits the extra fuel consumption of the drive engine for realizing the comfort function.

A state signal is detected for predicting or detecting movement driving of the loading apparatus, wherein this state signal indicates whether the loading apparatus is in a certain operating state (e.g., on/activated or off/deactivated).

In another embodiment, the loading apparatus is driven hydraulically. This driving is done by means of a hydraulic drive pump of the utility vehicle that is hydraulically connected to the loading apparatus and optionally to additional hydraulic units (e.g., brake, steering). In this case, it is favorable to initially determine a target hydraulic flow rate (e.g. in liters per minute) based on the predicted or detected movement driving of the loading apparatus and then to request an increase of the engine speed as a function of the determined target hydraulic flow rate. Based on the predicted or detected movement driving of the loading apparatus, for example, a hydraulic volume required for carrying out this drive movement can be determined and the target hydraulic flow rate can be determined therefrom.

Further, the target hydraulic flow rate can be determined based on one or more detected valve control signals, wherein one or more valves for the movement driving of the loading apparatus, more particularly a tool of the loading apparatus, can be controlled with these valve control signals. For example, a valve opening percentage or a time duration of the valve opening can be detected in order to support a determination of the target hydraulic flow rate in a technically simple manner.

It is additionally favorable if at least one of the following features is considered for determining the target hydraulic flow rate:

- a requested drive movement of the loading apparatus,
- a drive characteristic of the loading apparatus, and
- a requested target position of the loading apparatus.

The above-mentioned features or information can be retrieved at least partially as stored data and thus support accuracy during determination of the target hydraulic flow. For example, an evaluation of certain input commands by the user can determine the direction, path or pivot axis along which the loading apparatus or components thereof (e.g., the working unit or tool thereof) are to be moved. A target hydraulic flow rate can then be ascertained from this determined information.

If a target position of the loading apparatus is requested, this target position has already been stored in a previous work process in a device for carrying out the method, e.g., by means of a single position-save key on an operating unit. Alternatively, a desired target position can be stored by manually inputting various data at an operating interface, wherein the input data represents the target position. Independently of the type of storage, the target position can include a variety of data such as a pivot angle of an arm or a tool (shovel, fork, gripper, etc.) on the arm, a lift height of the loading apparatus, data for a hydraulic valve such as a percent valve opening or a time duration of the valve opening for producing a target hydraulic pressure, a clamping force or a clamping pressure of a tool (e.g., fork or gripper) of the loading apparatus. This clamping force is used in particular to support a reliable transport of bales or other materials. A current clamping pressure of this tool is determined or adjusted by means of appropriate sensors. This clamping pressure or clamping force can be displayed to a user on a display unit or operating interface. As already mentioned, a user can input a desired clamping force as data for the desired target position of the tool, or can request the already stored clamping force for a new work process. Thus, a clamping force judged to be suitable remains constant and a uniformly efficient work process is guaranteed.

In order to achieve a suitable clamping force, the clamping force can be input or displayed directly at an operating interface. Alternatively, a corresponding hydraulic flow rate and a time duration related thereto can be input or displayed when the clamping force is to be adjusted via a hydraulic cylinder. A pressure measurement in this hydraulic cylinder and characteristic lever relationships or other geometric variables of the tool can be called upon for determining a current clamping force. This current clamping force can then be compared to a requested target clamping force. Based on the result of the comparison, a hydraulic flow rate can then be controlled such that the target clamping force is set.

Taking account of the clamping force or the clamping pressure ensures in the case of round silage bales, for example, that each round bale is subjected to a sufficient clamping force to guarantee the secure transport thereof. Differences in size and shape of the bales can be automatically compensated. This additionally avoids excessive crushing of the bales, which can result in tears and damage to the bale or the film surrounding it and consequently rotting in the bale and loss of fodder quality. Therefore, no costs are incurred for removing the rot or disposing of such bales and procuring replacement fodder.

In combination with the above-mentioned target position, three functions are controlled with relation to movement driving of the loading apparatus, namely a position of the loading apparatus arm, a position of a loading apparatus tool and a clamping force of the tool (e.g., fork or gripper). To achieve the target position, these three functions can be automatically activated, simultaneously or coordinated relative to their drive movements. In particular, one hydraulic cylinder is activated for each function.

Due to the above-mentioned storage, it is only necessary to request a stored target position, whereby the required hydraulic flow or the hydraulic volume for achieving this target position can be determined very precisely in advance. In addition, the automatic achievement of the required target position can replace a manual actuation of the loading apparatus, which can reliably prevent incorrect operation and thus possible damage by the loading apparatus (to adjoining buildings and to the loading material, for example).

A stored position can be requested by the operator by means of a suitable operating device. For example, the operator may press a key on a hand lever, a joystick or the like. Alternatively, touching one or more visual buttons on an operating interface (e.g., a video screen) can be provided in order to trigger a drive movement of the loading apparatus in the direction of the target position.

In another embodiment, a foot pedal operable by a foot is provided as the operating device for triggering a drive movement of the loading apparatus, more particularly in the direction of a target position. A conventional clutch pedal is suitable for this without substantial technical extra effort, so long as it is no longer needed for gear-engagement purposes in the transmission installed in the utility vehicle (e.g., an IVT transmission). In such cases, the conventional clutch pedal can then be used for raising or lowering a loading apparatus. This function of the clutch pedal can be fixedly specified in the utility vehicle. Alternatively, this clutch pedal can be optionally configured with different functions. For example, one of a number of possible positions can be assigned to the clutch pedal via an operating interface for this purpose. If needed, the currently assigned function can be replaced by a different function. The foot pedal can therefore flexibly satisfy different user-specific functions. The signals of the pressed foot pedal are processed in an appropriate control device and converted thereby into control signals, for example, for controlling the movement of a loading apparatus. Such a foot pedal can improve the operating comfort for the operator and thus reduce his workload during the working movements of the loading apparatus that are to be carried out.

The above-mentioned drive characteristic contains, in particular, specific features of the loading apparatus in use, e.g., hydraulics-specific information regarding the model used or the geometrical dimensioning thereof.

In another embodiment, the target hydraulic flow is determined depending on at least one hydraulic unit (e.g., brake, steering) of the utility vehicle, which further improves the accuracy for the required increase of engine speed.

To limit the extra fuel consumption of the drive engine, it is advantageous to request an increase of the engine speed only for a defined period of time, a so-called request period. This request period is determined or calculated as a function of the determined target hydraulic flow. The determination of the request period makes particular sense and is possible with great precision if the target hydraulic flow for a requested target position is determined, because then the hydraulic volume necessary for reaching the target position is known or can be determined with great precision. The determined request period can also be further processed for making a decision as to whether an elevated engine speed is actually maintained for the duration of the request period or only for a shorter or longer period.

To avoid constantly changing increases of the engine speed and therefore unnecessary extra fuel consumption, the elevated engine speed is limited such that it is at most as large as a predetermined limit speed. If engine speeds are requested that are greater than the limit speed, the drive engine is thus driven at the limit rotational speed.

The engine speed can be increased at a preset or determined rate of increase or be lowered at a preset or determined decrease rate at a given point in time following the increase. This takes account of the inertia of the drive engine and further limits unnecessary extra fuel consumption of the drive engine.

In particular, an elevated engine speed is to be maintained for a determined or preset holding period. This holding period can be shorter or longer than the above-mentioned request period. The holding period is preset or determined based on a consumption-oriented process management (i.e., shortest possible period to limit the extra consumption of fuel) or of a power-oriented process management (i.e., relatively long period to support the drive power for the loading apparatus or the driving power of the utility vehicle). A predetermination of the holding period as a function of the determined request period is also possible.

According to an additional measure, the elevated engine speed is initially maintained after expiration of a predetermined holding period if the requested engine speed is at least as high as the elevated engine speed at the point when the holding period expires. This measure also contributes to the avoidance of constantly alternating increases of the engine speed and unnecessary extra fuel consumption for the drive engine.

Overall, the above-mentioned measures, in combination with the limit rotational speed, the rate of increase, the rate of decrease and the holding period enable a smoothing of requested increases of engine speed and thus a more uniform drive power of the drive engine with a simultaneous limitation of the excess fuel consumption arising during the performance of the method.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
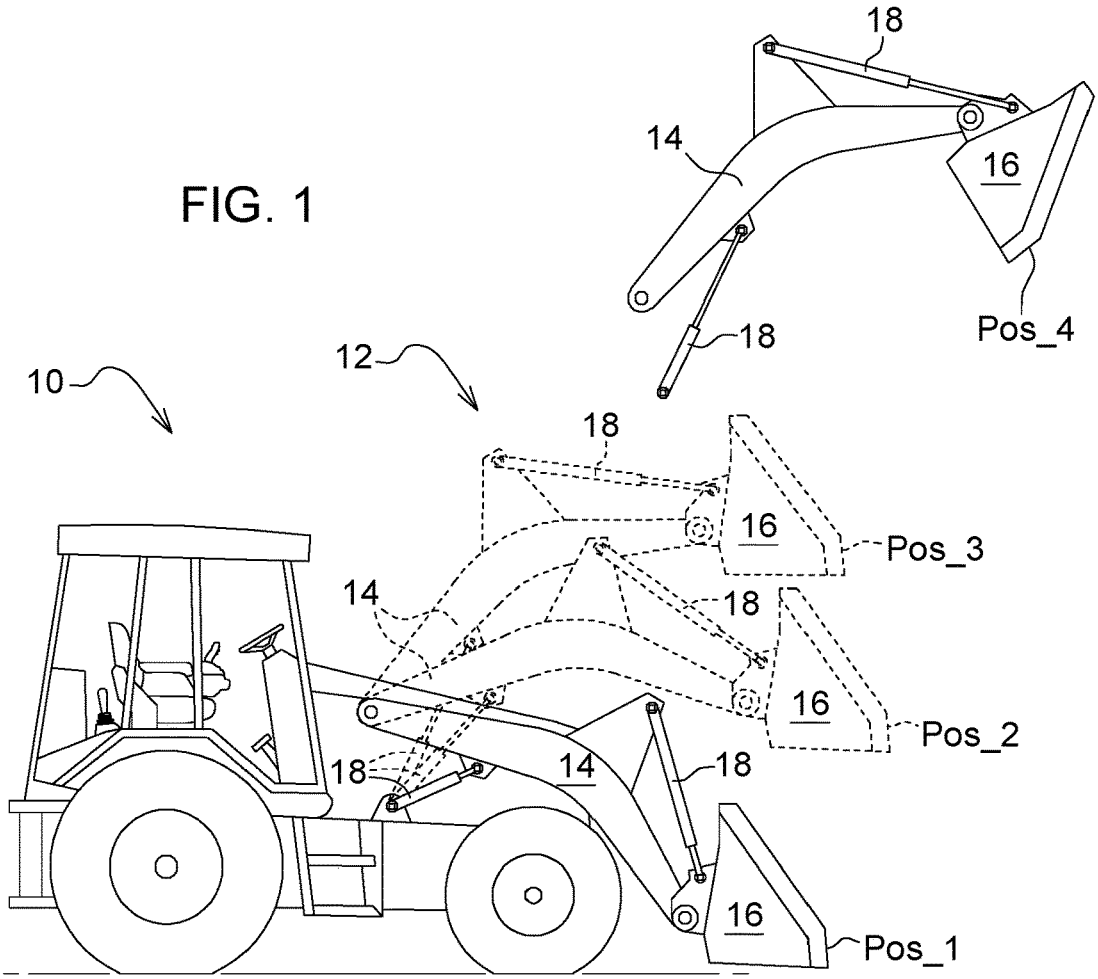
FIG. 1 shows a side view of a tractor with a front loader in different working positions.

FIG. 1 shows a utility vehicle constructed as a tractor 10, on the front side of which a loading apparatus constructed as a front loader 12 is mounted. The front loader 12 has a pivotable arm 14, at the free end of which a tool in the form of a shovel 16 is pivotably mounted. The arm 14 and the shovel 16 are driven hydraulically to assume different positions, e.g., the positions Pos_1, Pos_2, Pos_3 and Pos_4 illustrated in FIG. 1. In the positions Pos_1, Pos_2, and Pos_3, the arm 14 assumes different pivot angles relative to the tractor 10. The shovel 16 assumes different pivot angles relative to the arm 14 in the positions Pos_1, Pos_2, Pos_3 and Pos_4. The position Pos_3 can constitute a maximum lift height of the arm 14 or the loading apparatus 12 for certain work, in order to avoid damage to adjoining buildings, gate entryways or the like. The hydraulic movement power is provided by means of suitable hydraulic cylinders 18, which are mounted on the loading apparatus 12.

The method for controlling an engine speed n of a drive engine of the tractor 10, not shown in detail, provides that movement driving of the loading apparatus 12 is initially predicted or detected and then an increase of the engine speed n of the drive engine is requested. The increase of the engine speed n is thus requested, for example, if future movement driving is predicted or movement driving has actually been requested and detected.

Figure 2:
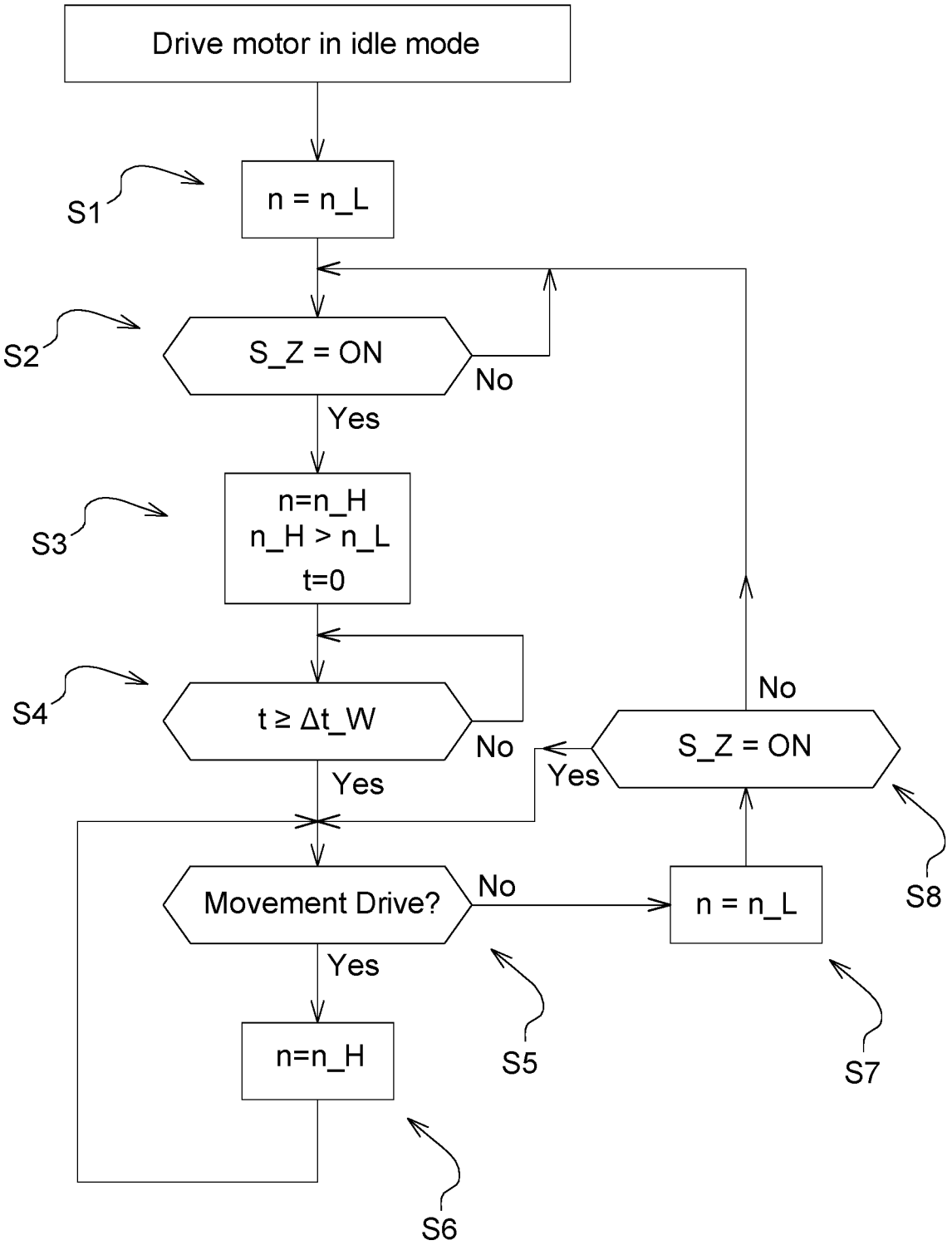
FIG. 2 shows a flow chart of the performance of the method in a first embodiment.

According to FIG. 2, this method is applied as follows in an idling mode of the drive engine. The engine speed n initially corresponds to an idle speed n_L when the tractor 10 is stationary (step S1). The idle speed n_L is 850 rpm (revolutions per minute), for example. In a step S2, it is checked whether a state signal S_Z indicates an activated operating state (On) of the loading apparatus 12 or a different drive state, e.g., a deactivated operating state (Off). In the event of a detected activated operating state, it is assumed that movement driving or a drive movement will be requested with a high probability thereafter. Therefore, future movement driving is predicted. According to the method, an increase of the engine speed n is requested. The engine speed n is increased to the engine speed n_H (step S3). It is 1000 rpm, for example. At the time when the engine speed n is increased to n_H, a time counter is also activated, which begins at t=0 and ends upon expiration of a waiting period Δt_W, e.g., 1 minute (step S4). It is checked in step S5 whether movement driving or a drive movement has already been carried out or at least requested upon expiration of the period Δt_W. If yes, the elevated engine speed n_H is maintained (step S6). If no, the elevated engine speed n_H is reduced (step S7) in order to further reduce the increased fuel consumption. The elevated engine speed n_H is in particular reduced to the original idle speed n_L. Then it is checked in step S8 whether the operating state of the loading apparatus is still activated (S_Z=On). If this is the case, control returns to step S5 to check whether movement driving has been carried out or at least requested. If yes, the engine speed n is again increased (step S6). If it is determined in step S8 that the operating state of the loading apparatus is no longer activated, control returns to step S2.

Figure 3:
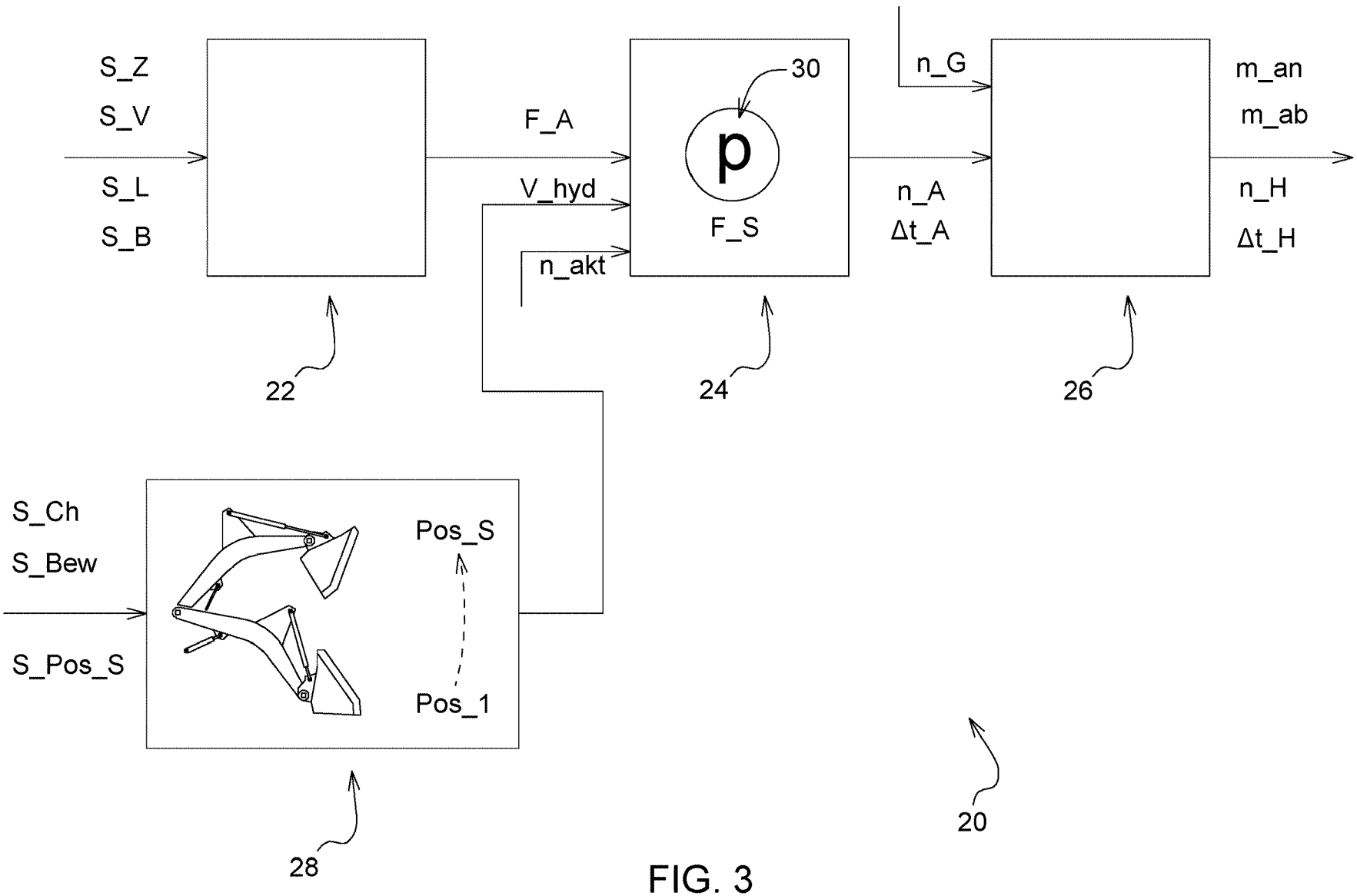
FIG. 3 shows a representation similar to a block schematic diagram of components of an arrangement for performing the method.

FIG. 3 schematically shows parts of an arrangement 20 for carrying out the method for controlling the engine speed n. In particular, the arrangement 20 is used for performing the method at any desired engine speeds n other than the idle speed n_L. The working blocks 22, 24, 26, 28 that are shown are used for implementing a control of the engine speed n, which takes effect depending on a hydraulic flow to be described below. In another embodiment of the arrangement 20 not shown here, additional working blocks and components are provided, which also consider the control of the engine speed n in idle mode according to FIG. 2.

The arrangement 20 according to FIG. 3 assumes that the loading apparatus 12 and optionally additional units as well (e.g., steering, brake) are hydraulically driven. The tractor 10 has a hydraulic drive pump 30 for this purpose. The pump characteristic thereof (in particular a characteristic curve with a hydraulic flow (liters/min) as a function of the engine speed) is taken into consideration in the working block 24 in order to determine the higher engine speed n_A that is to be requested. The engine speed n_A to be requested is calculated as a function of a determined target hydraulic flow F_S. In particular, the engine speed n_A is requested for the request period Δt_A, i.e., the engine speed n_A is to be in effect during the request period Δt_A.

The request period Δt_A is used in particular as an output signal of the working block 24, especially if a required hydraulic volume V_hyd is being calculated in the working block 28, and the period is sent as a signal to the working block 24. In this case, the target hydraulic flow F_S can be determined while taking into account a current engine speed n_akt of the drive motor and a requested hydraulic flow F_A, and the request period Δt_A can be determined therefrom. The hydraulic volume V_hyd represents a hydraulic volume that is estimated or calculated in order to be able to perform the predicted or detected movement driving of the loading apparatus 12. In this regard, a drive characteristic S_Ch (e.g., drive type, drive geometry, geometry of the hydraulic cylinders 18, etc.) and a requested drive movement S_Bew (e.g., a request for specific pivot movements of the arm 14 or the tool 16 by means of corresponding operating elements) of the loading apparatus 12 can be considered as input signals. When determining the hydraulic volume V_hyd, an input signal S_Pos_S is taken into particular consideration in the working block 28. More specifically, this signal represents the request for a target position Pos_S of the loading apparatus 12 that has already been stored and is therefore known with respect to the hydraulic requests. For example, the loading apparatus is in the starting position Pos_1 prior to the request for the target position Pos_S. Based on the known hydraulic initial and target positions and the known drive characteristic S_Ch, the required hydraulic volume V_hyd can then be predicted especially accurately in working block 28.

The requested hydraulic flow F_A is an output signal of the working block 22. Input signals regarding the operating state (S_Z) of the loading apparatus 12, of a steering system (S_L, e.g., a steering angle) of the tractor 10, of a brake unit (S_B, e.g., status of the brake) and valve control signals S_V of hydraulic valves of the loading apparatus 12 are considered as input signals for this output signal, for example.

In summary and based on the above explanations, the target hydraulic flow F_S is determined on the basis of movement driving of the loading apparatus 12 predicted or detected in the working block 22 or in the working block 28.

The requested engine speed n_A, optionally the request period Δt_A and a predetermined limit speed n_G, as well as additional parameters or variables if appropriate, are evaluated in the working block 26. Depending on consumption-oriented aspects (in particular the least possible extra consumption of fuel), performance-oriented aspects (in particular, the quickest possible implementation of the requested movement driving) or load-oriented aspects (in particular the lowest possible load on the drive engine), an elevated engine speed n_H that is actually to be implemented, a holding period Δt_H for maintaining the elevated engine speed n_H, a higher increase rate m_an of the engine speed n and a decrease rate m_ab of the elevated engine speed n_H are determined from the input signals of the working block 26, or are predetermined, and are transmitted as output signals for controlling the drive engine (e.g., an engine control unit).

Different activations of the drive engine are shown for the sake of example with reference to FIGS. 4-8. The curves in broken lines show requested increases of the engine speed n and possibly request periods Δt_A. The curves in solid lines show the elevated engine speeds n_H and the holding periods Δt_H, with which the drive engine is actually controlled based on the evaluation in the working block 26.

Figure 4:
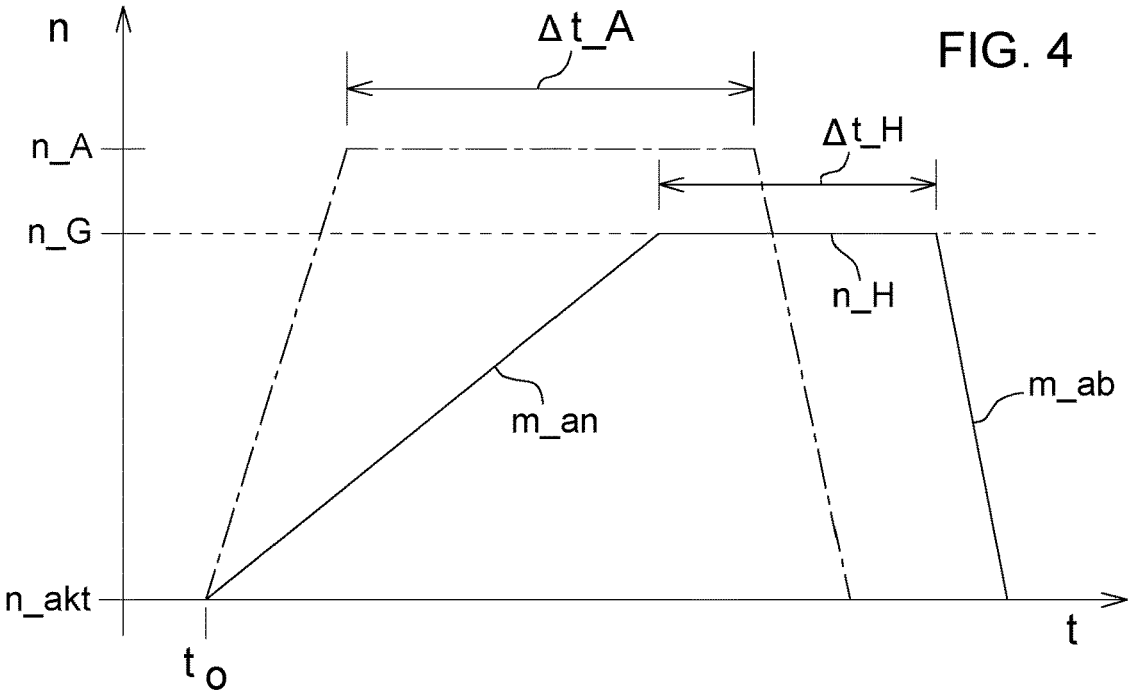
FIGS. 4-8 show representations of the requested engine speed increase and the actually elevated engine speed as a function of time.

In FIG. 4, a higher speed n_A for a request period Δt_A is requested starting from a point in time to at a current speed n_akt. For the limit speed n_G, however, a lower value is predetermined in comparison to the requested higher speed n_A. The actually achieved elevated speed n_H thus corresponds to the limit speed n_G. Based on consumption-oriented overall conditions, the elevated speed n_H is maintained only for a holding period of elevated engine speed n_H that is shorter than the request period Δt_A. In addition, the current speed n_akt is increased at a smaller increase rate m_an than was requested, in order to limit the extra consumption of fuel and the extra load on the drive engine.

Figure 5:
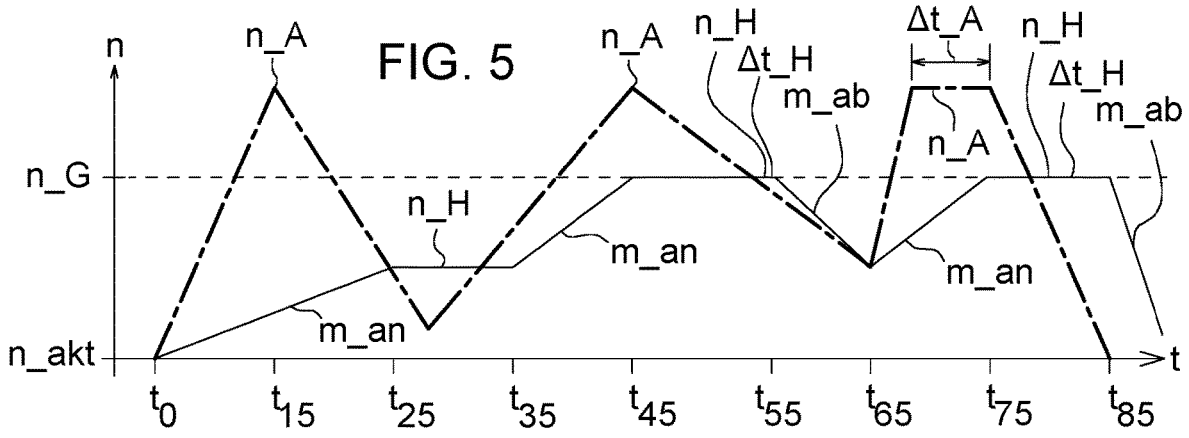

In FIG. 5, a higher speed n_A is requested for the time $t_{15}$. The speed n is actually increased with a lower increase rate m_an up to time $t_{25}$. The engine speed n thus initially remains at an increased speed n_H below the limit speed n_G because a further decrease of the engine speed n was requested in this case and constant changes of engine speeds are to be avoided. Starting from time $t_{35}$, the requested speed is again higher than the elevated speed n_H achieved between $t_{25}$ and $t_{35}$. The engine speed n therefore continues to increase and is limited at time $t_{45}$ as an elevated engine speed n_H due to the predetermined limit speed n_G. Between times $t_{45}$ and $t_{55}$, the elevated engine speed n_H is maintained for the holding period Δt_H. Thereafter, the elevated engine speed n_H is again reduced at the decrease rate m_ab. For time $t_{65}$, an increase of the engine speed n is again requested with a value n_A above the limit speed n_G. Accordingly, the engine speed is again increased at an increase rate m_an with a limitation by the limit speed n_G (time $t_{75}$). After expiration of the holding period Δt_H at time $t_{85}$, the elevated engine speed n_H is again reduced at a decrease rate m_ab.

Figure 6:
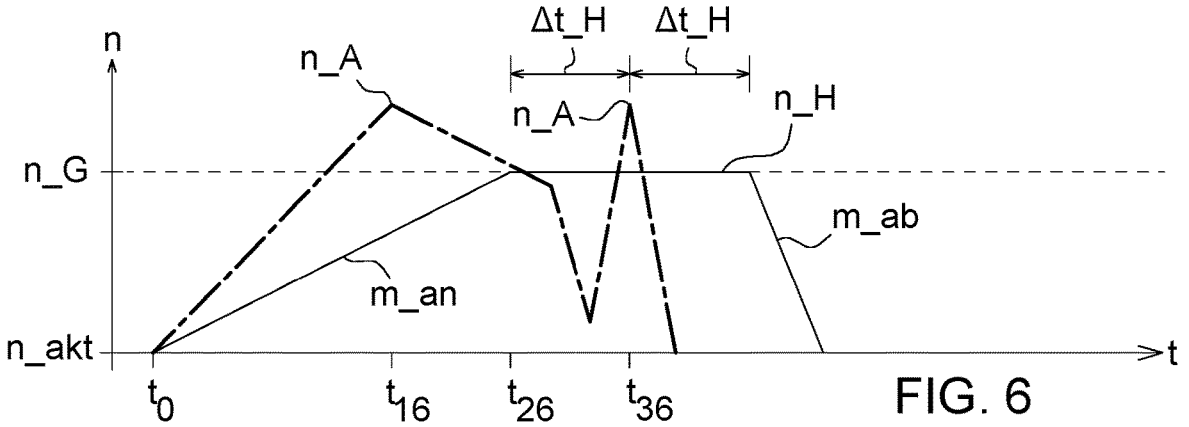

In FIG. 6, a higher engine speed n_A above the limit speed n_G is requested for time t16. Consequently, the engine speed n is increased at a predetermined increase rate m_an with the limit speed n_G as the elevated engine speed n_H. The holding period Δt_H begins at time t26 and ends at time $t_{36}$. Since a higher speed n_A above the limit speed n_G was again requested for this latter time, the elevated engine speed n_H continues to be maintained. In FIG. 6, this is maintained for an additional holding period Δt_H.

Figure 7:
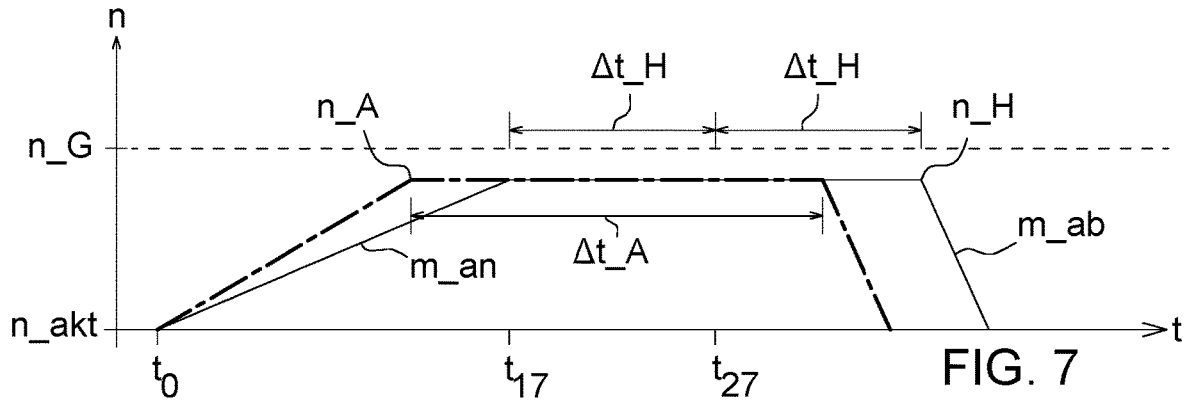

In FIG. 7, the value of the elevated engine speed n_H corresponds to the value of the requested higher engine speed n_A because the latter lies below the limit speed n_G. Starting from time t17, the elevated engine speed n_H is maintained for the time span of the holding period Δt_H. Since a higher engine speed n_A was still being requested upon expiration of this first holding period Δt_H at time t27, the elevated engine speed n_H—analogously to the sequence in FIG. 6—is maintained for an additional holding period Δt_H.

Figure 8:
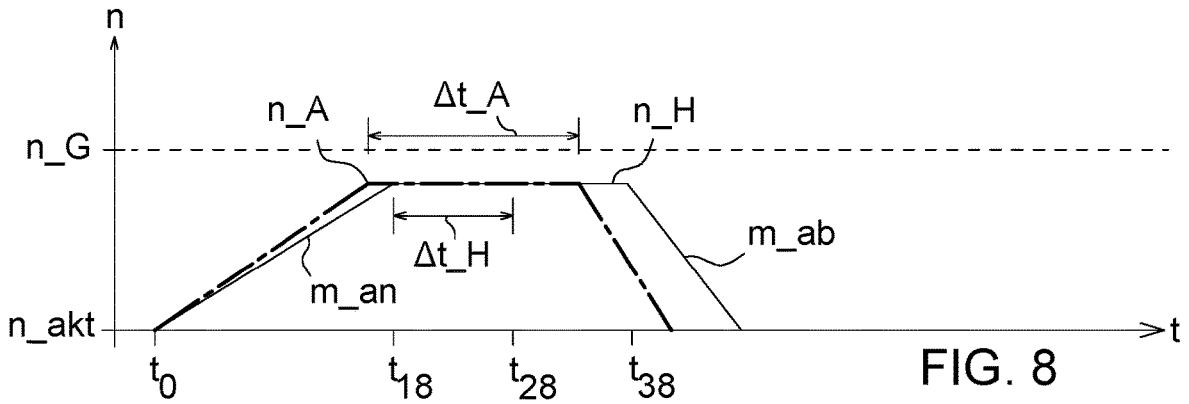

FIG. 8 shows the same requested higher engine speed n_A with the same request period Δt_A as in FIG. 7. However, the maintenance of the elevated engine speed n_H over a multiple of the holding period Δt_H has the disadvantage in FIG. 7 that it is maintained over a longer period than was requested with the request period Δt_A. In order to proceed in a fuel saving manner in such cases, the time intervals for this maintenance of the elevated engine speed n_H can be predetermined or ascertained in working block 26, according to the principle described below.

If the request period Δt_A is less than the holding period Δt_H, the elevated engine speed n_H is maintained over the period of a single holding period Δt_H. If the request period Δt_A is equal to or larger than the holding period Δt_A, the elevated engine speed n_H is maintained over the period of the request period Δt_A. In FIG. 8, this means that the elevated engine speed n_H is maintained after expiration of the holding period Δt_H only for the period $t_{28}$ to $t_{38}$, where the period $t_{28}$ to $t_{38}$ corresponds to the request period Δt_A. This principle of a shortening of the time interval, and thus a limitation of the temporarily increased fuel consumption, for maintaining the elevated engine speed n_H can of course also be used in different variants of an increase of the engine speed n, e.g. the variants according to FIGS. 4-7.

While exemplary embodiments incorporating the principles of the present disclosure have been disclosed hereinabove, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A method for controlling engine speed of a drive engine of a utility vehicle having a drivable loading apparatus, comprising:

detecting or predicting a driving movement of the loading apparatus;

requesting an increase of engine speed if the movement of the loading apparatus is predicted or detected;

increasing the engine speed by a predetermined increase rate to an elevated engine speed; and predicting movement of the loading device before the detecting step.

2. The method of claim 1, further comprising controlling the engine speed at an idling speed when the utility vehicle is stationary.

3. The method of claim 1, further comprising:

triggering a predetermined waiting period;

determining if the elevated engine speed is elevated about a predetermined limit speed;

reducing the engine speed if the predetermined waiting period has expired and no driving movement of the loading apparatus has been requested until the expiration of the waiting period.

4. The method of claim 1, wherein the driving movement of the loading apparatus is predicted or detected depending on a detected state signal, wherein the state signal is indicative of an operating state of the loading apparatus.

5. The method of claim 1, further comprising:

hydraulically driving the loading apparatus;

determining a target hydraulic flow of a hydraulic drive pump of the utility vehicle depending on the predicted or detected driving movement of the loading apparatus; and requesting the increase of engine speed based on the determined target hydraulic flow.

6. The method of claim 5, wherein the determining step comprises determining the target hydraulic flow based on a detected valve control signal for at least one hydraulic valve of the loading apparatus.

7. The method of claim 5, wherein the determining step comprises determining the target hydraulic flow based on at least one of a requested drive movement of the loading apparatus, a drive characteristic of the loading apparatus, and a requested target position of the loading apparatus.

8. The method of claim 5, wherein the determining step comprises determining the target hydraulic flow based on at least one hydraulic unit of the utility vehicle.

9. The method of claim 5, wherein the requesting step comprises requesting the increase of the engine speed for a request period that is determined based on the target hydraulic flow.

10. The method of claim 1, wherein the elevated engine speed is less than or equal to a predetermined limit speed.

11. The method of claim 1, further comprising lowering the engine speed at a predetermined decrease rate after being increased.

12. The method of claim 1, further comprising maintaining the elevated engine speed for a holding period.

13. The method of claim 12, wherein the maintaining step comprises maintaining the elevated engine speed after expiration of a predetermined holding period if the requested engine speed is at least as high as the elevated engine speed at the point when the holding period expires.

14. A method for controlling engine speed of a drive engine of a utility vehicle, comprising:

providing the vehicle with a drivable loading apparatus and a hydraulic drive pump;

hydraulically driving the loading apparatus;

detecting a driving movement of the loading apparatus;

determining a target hydraulic flow of the hydraulic drive pump of the utility vehicle based on a predicted or detected driving movement of the loading apparatus;

requesting an increase of engine speed based on the determined target hydraulic flow if movement of the loading apparatus is detected; and predicting movement of the loading device before the detecting step.

15. The method of claim 14, wherein the determining step comprises determining the target hydraulic flow based on a detected valve control signal for at least one hydraulic valve of the loading apparatus.

16. The method of claim 14, wherein the determining step comprises determining the target hydraulic flow based on at least one of a requested drive movement of the loading apparatus, a drive characteristic of the loading apparatus, and a requested target position of the loading apparatus.

17. A method for controlling engine speed of a drive engine of a utility vehicle, comprising:

providing the vehicle with a drivable loading apparatus and a hydraulic drive pump;

hydraulically driving the loading apparatus;

detecting a driving movement of the loading apparatus;

determining a target hydraulic flow of the hydraulic drive pump of the utility vehicle based on a predicted or detected driving movement of the loading apparatus;

requesting an increase of engine speed if movement of the loading apparatus is detected; and predicting movement of the loading device before the detecting step.

18. A method for controlling engine speed of a drive engine of a utility vehicle, comprising:

providing the vehicle with a drivable loading apparatus and a hydraulic drive pump;

hydraulically driving the loading apparatus;

detecting a driving movement of the loading apparatus;

determining a target hydraulic flow of the hydraulic drive pump of the utility vehicle based on a predicted or detected driving movement of the loading apparatus;

requesting an increase of engine speed if movement of the loading apparatus is detected;

determining a request period of time based on the target hydraulic flow;

increasing the engine speed for a duration of the request period of time; and predicting movement of the loading device before the detecting step.

19. A method for controlling engine speed of a drive engine of a utility vehicle having a drivable loading apparatus, comprising:

detecting or predicting a driving movement of the loading apparatus;

requesting an increase of engine speed if the movement of the loading apparatus is predicted or detected;

increasing the engine speed by a predetermined increase rate to an elevated engine speed;

triggering a predetermined waiting period;

determining if the elevated engine speed is elevated about a predetermined limit speed; and reducing the engine speed if the predetermined waiting period has expired and no driving movement of the loading apparatus has been requested until the expiration of the waiting period.

20. A method for controlling engine speed of a drive engine of a utility vehicle having a drivable loading apparatus, comprising:

detecting or predicting a driving movement of the loading apparatus;

requesting an increase of engine speed if the movement of the loading apparatus is predicted or detected;

increasing the engine speed by a predetermined increase rate to an elevated engine speed; and lowering the engine speed at a predetermined decrease rate after being increased.

* * * * *